US006802267B1

(12) United States Patent
Janus

(10) Patent No.: US 6,802,267 B1
(45) Date of Patent: Oct. 12, 2004

(54) EASILY ASSEMBLED PALLET

(76) Inventor: Paul J. Janus, 4101 SE. 102 Ave., Portland, OR (US) 97266

( * ) Notice: Subject to any disclaimer, the term of this patent is extended or adjusted under 35 U.S.C. 154(b) by 0 days.

(21) Appl. No.: 10/250,227

(22) Filed: Jun. 15, 2003

(51) Int. Cl.[7] ..... B65D 19/12
(52) U.S. Cl. ..... 108/56.1
(58) Field of Search ..... 108/56.1, 56.3, 108/51.11, 51.3

(56) References Cited

U.S. PATENT DOCUMENTS 3,118,400 A * 1/1964 Kemp, Jr. et al. ..... 108/57.1
5,158,403 A * 10/1992 Moors ..... 108/56.3
5,170,722 A * 12/1992 Friesner et al. ..... 108/56.1
5,333,555 A * 8/1994 McPhee ..... 108/57.19
5,402,735 A * 4/1995 DeJean ..... 108/57.17
5,579,701 A * 12/1996 Fook Wah ..... 108/56.1
5,809,902 A * 9/1998 Zetterberg ..... 108/51.11
5,896,818 A * 4/1999 Phillips ..... 108/51.11
6,105,512 A * 8/2000 Lin ..... 108/56.3
6,354,228 B1 * 3/2002 McPhee et al. ..... 108/51.11
6,408,770 B1 * 6/2002 Mason ..... 108/54.1

FOREIGN PATENT DOCUMENTS

JP 6-239344 * 8/1994

* cited by examiner

*Primary Examiner*—Jose V. Chen
(74) *Attorney, Agent, or Firm*—Henry G. O'Donohoe

(57) ABSTRACT

An easily assembled pallet, having two runners set apart and opposed, joists slidibly attached between the runners, and two retainers slidibly connected to each of the runners and contacting the joist end bottom surface thereby keeping the joists in proper location in the runners. Whereby the top of the joists forms the pallet's top flat surface. In addition, a support bar can be attached to the bottom of the joists between the runners to provide additional support and stiffness to the joists.

14 Claims, 7 Drawing Sheets

EASILY ASSEMBLED PALLET

BACKGROUND OF INVENTION

The present invention relates to pallets, primarily to pallets that can be assembled and disassembled, and pallets moved by fork trucks.

Many products and goods are moved and stored on pallets. The majority of these pallets are constructed of wood and remain assembled after use because they cannot easily be taken apart. Other pallets constructed of plastic or paperboard cannot be disassembled at all. When not in use the pallets are usually stored and/or shipped back to their originator. Pallets, which cannot be collapsed or disassembled, require a large amount of space for storage and trucking. In addition, if a portion of the pallet is damaged, the whole pallet is discarded and a replacement procured. Space, material and time cost money to a business. Storage and transport of empty pallets has associated costs that can be reduced by keeping pallets unassembled while not in use. In addition, pallets constructed of matching parts and easily disassembled have the advantage of only requiring replacement of damaged parts. The pallet assembly also must not take a substantial amount of time to put together or take apart, the cost of which may be recovered from the savings in storing, return shipping, and replacement.

SUMMARY OF INVENTION

It is the intent of the present invention to provide an easily assembled and disassembled pallet manufactured of plastic or other suitable material and constructed of a number of specific parts. The pallet would be delivered to a user in the unassembled form. Varying the lengths of associated parts will also make pallets of different sizes.

The general purpose of the present invention is a pallet assembly can easily be assembled and unassembled.

It is an object of the present invention to have the storage of the pallet in an unassembled form thereby requiring less space for storing and shipping. Smaller trucks may be used to transport the pallets; or more can be transported in the same size truck.

Another object of the present invention is to provide a versatile pallet by varying the sizes of associated parts and not requiring a separate top sheet.

A further object of the present invention is to provide like parts for all pallets of the same size and load rating. Which allows easy replacement of damaged parts.

Another object of the present invention is to enable the assembly or disassembly to be accomplished within a few minutes without tools.

BRIEF DESCRIPTION OF DRAWINGS

All 8 views are viewed from the same direction.

DETAILED DESCRIPTION

Figure 1:
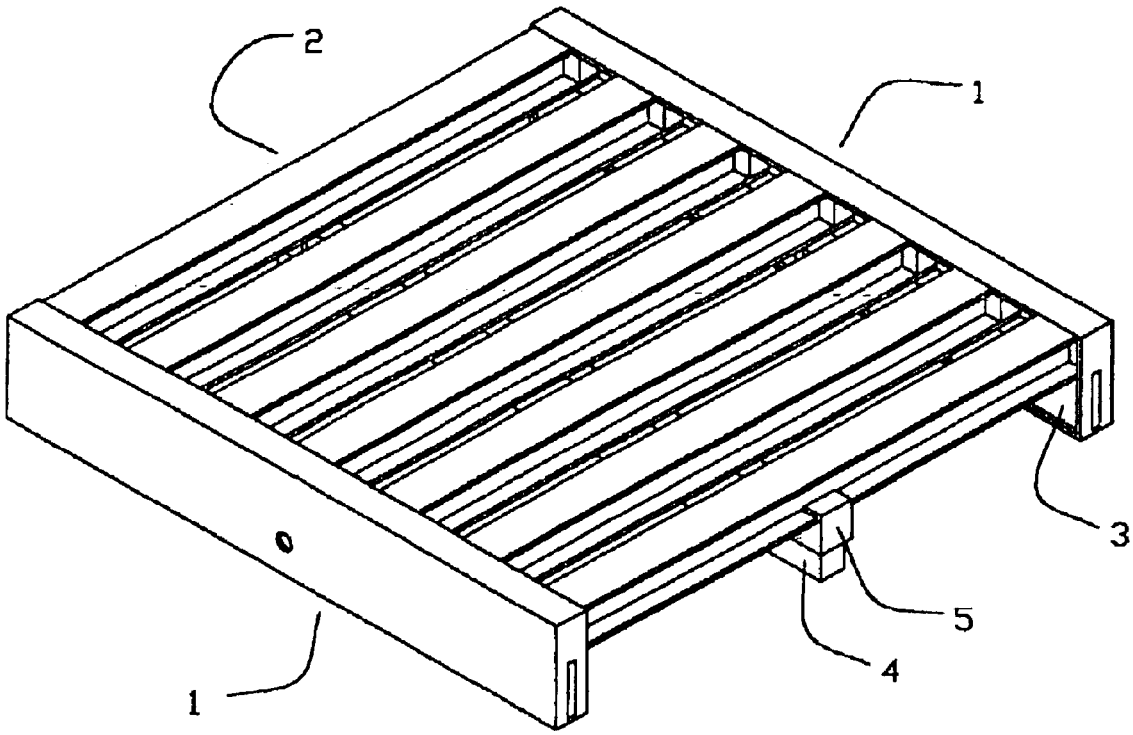
FIG. 1 is a perspective rendition of the completely assembled pallet.

FIG. 1 shows a perspective of a completed easily assembled pallet having two opposed and parallel runners 1, at least one joist 2 connected at either end to runners 1, two retainer bars 3 one each inserted in runners 1 to hold the joists 2 in place vertically so that a flat surface is formed by the top surfaces of the runners 1 and joists 2. At least one support member 4 to provide additional strength and support for joists 2, and two end fasteners 5 to hold the support member 4 in place (only one end fastener is visible in this figure). The parts of the pallet may be constructed of different types of plastic, any other suitable material, or a combination of materials. The material used needs to be selected for required strength, resiliency, and durability, ease of manufacture, cost, and other such considerations. The height of the runners 1 and support member 4 are such that forks of a lift truck will easily slide below the joists 2. And, the spacing apart of runners 1 and support member 4 is such that a lift truck fork will pass between the support member 4 and runner 1. The support member 4 may not be required for light loading or small pallets.

Figure 2:
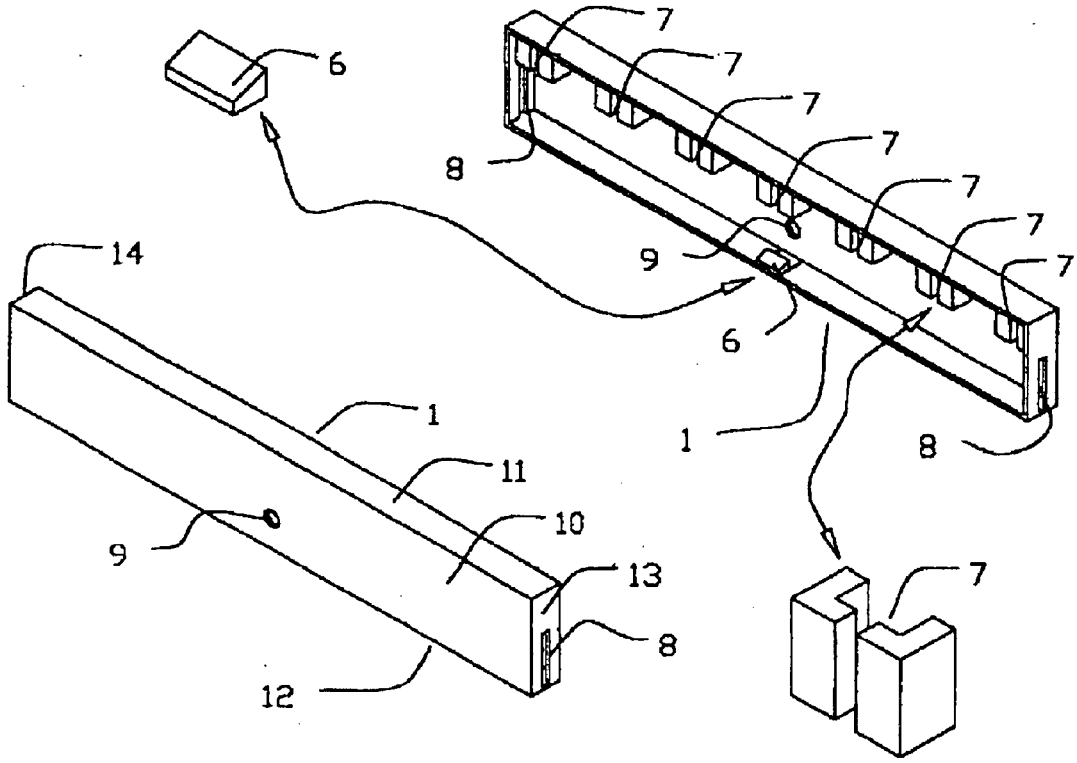
FIG. 2 is a perspective rendition of the runners.

A pair of runners 1 is shown in FIG. 2. For a given pallet size the runners are made identical in size and with the same number and spacing of keyways 7 so that they may be used interchangeably on either side. The at least one keyway 7 are formed as part of, or affixed to, the runner 1, and spaced such that there is minimal spacing between joists 2. The keyway 7 is shown as "T" shaped as can be seen in the enlarged view but can be any number of shapes. The keyway 7 contacts the inside surface of runner side 10. The top of the keyway 7 is also in contact with the runner top underside 11 of the runner 1. Depressor 6 is formed as part of, or affixed to, runner bottom 12. Depressor 6 is sloped to aid the placement of retainer bar 3 and to hold retainer bar 3 in place when assembled. To allow depressor 6 to be retractable from the retainer bar 3 during assembly and disassembly, slots are cut into runner bottom 12 along each side of depressor 6. A spring-loaded depressor 6 could be used if the runner material is inelastic. Slot 8 is cut completely through each of ends 13 and 14. Hole 9 is cut through surface 10, aligned with and above depressor 6.

Figure 3:
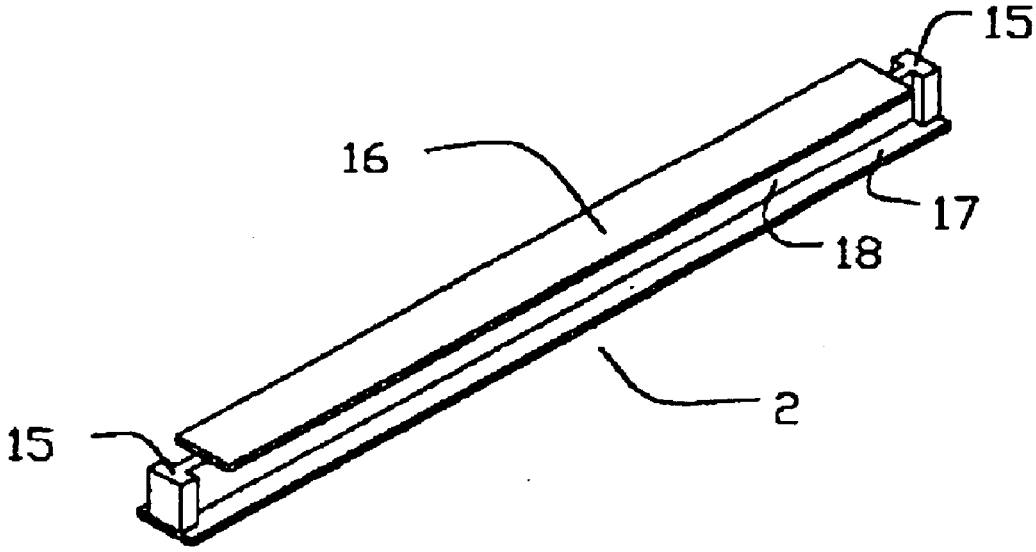
FIG. 3 is a perspective rendition of the joist.

FIG. 3 shows a joist 2 with ends 15, flanges 16 and 17, and web 18. At least one joist 2 is required when assembling a pallet. The joist end 15 is a key shown in the shape of a "T" matching the runner keyway 7 so the joist end 15 can be slip fit into the runner keyway 7. The joist top flange 16 is shorter on each end than the bottom flange 17 by an amount to allow the top flange to fit between the runner top surfaces 11. Thus, the length of the joist top flange 16 is limited to the spacing of the runners 1. This allows all top surfaces of the pallet to be flush and a tight fit can occur between the ends of flange 16 and runner top 11. If a tight fit is not required the top flange 16 length can be shorter. The end 15 is flush with the end of the bottom flange 17. When joist end 15 is inserted into runner keyway 7, joist end 15 and the end of flange 17 are to fit tightly against runner inside surface 10. Each end of the joist 2 are constructed the same so the joist 2 can be inserted into either runner 1. The joist 2 so installed forms the top surface of the pallet, therefore, no top sheet is required for a continuous surface. If a contiguous top pallet surface is not required some joists 2 can be left out of the assembly.

Figure 4:
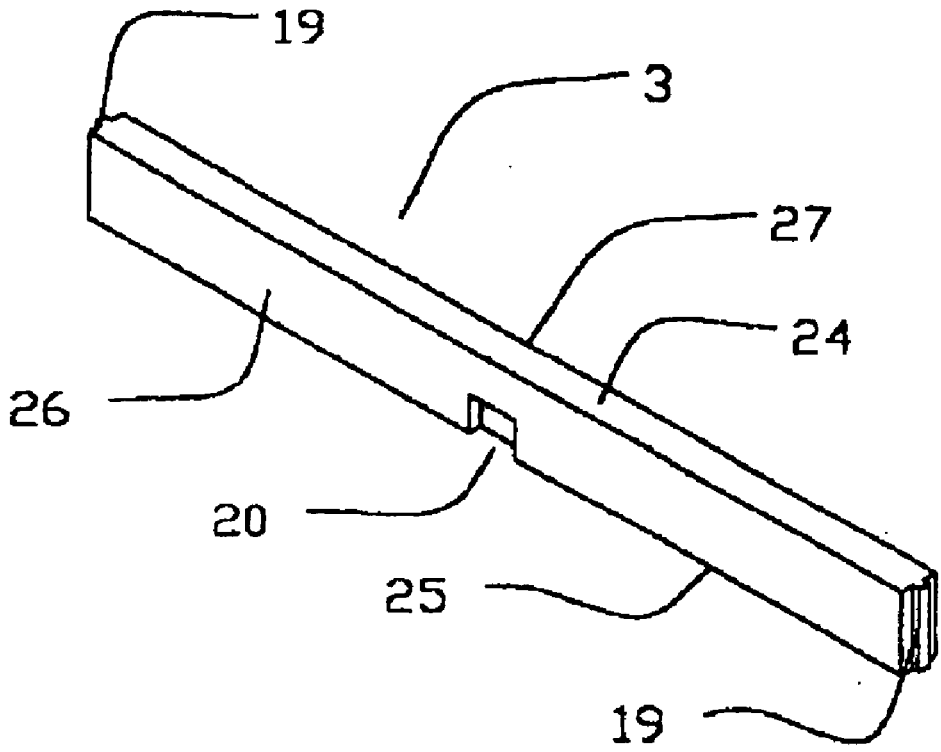
FIG. 4 is a perspective rendition of the retainer bar.

FIG. 4 shows in detail one retainer bar 3 having tongue ends 19, recess 20, top surface 24, bottom surface 25, front surface 26, and back surface 27. The retainer bar 3 must be flexible to allow a slight bending to take place during assembly. The overall length of retainer bar 3, including the two tongue ends 19 is the same length as runner 1 overall length from outside runner surface 13 to outside runner surface 14. Retainer bar 3 fits inside runner 1. Runner slot 8 and tongue 19 are of substantially the same size and shape with runner slot 8 being slightly larger to allow a slip fit with tongue 19. Recess 20 is provided for clearance of runner depressor 6 with additional finger clearance for removal of retainer bar 3 during disassembly. To avoid having to bend the retainer bar 3 the tongue ends 19 could be replaced with spring loaded tongues or pins; or the ends could be without tongues and held in place with screws or clamps.

Figure 5:
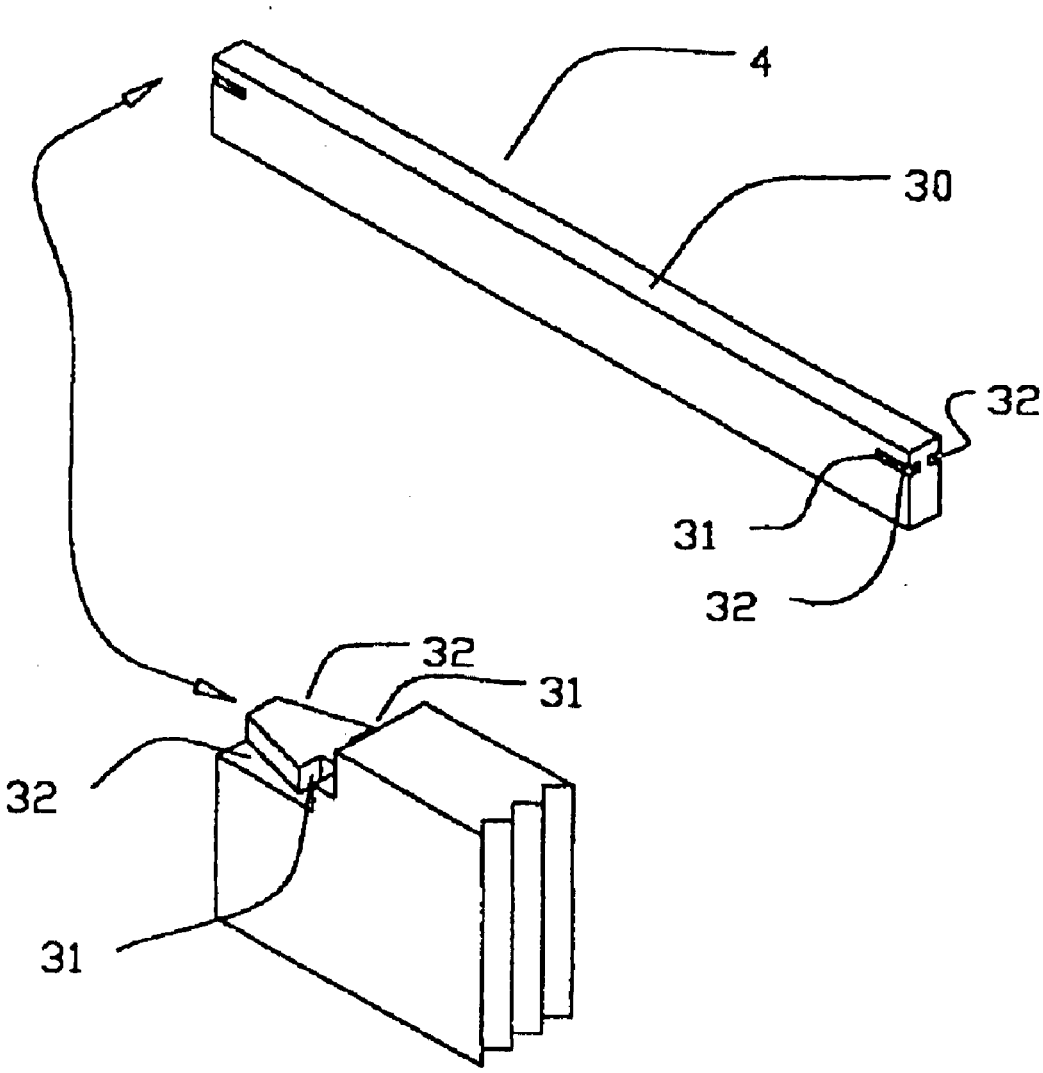
FIG. 5 is a perspective rendition of the support member.

FIG. 5 shows the support member 4 having a top surface 30. At each end of the support member 4 is formed a hole 31 and a slot 32 which is tapered from inside adjacent hole 31 towards the support member 4 free end as can be seen in enlarged view of FIG. 5 (Top portion above slot of support member 4 is shown removed for clarity). The height of slot 32 is the same as the diameter of hole 31.

Figure 6:
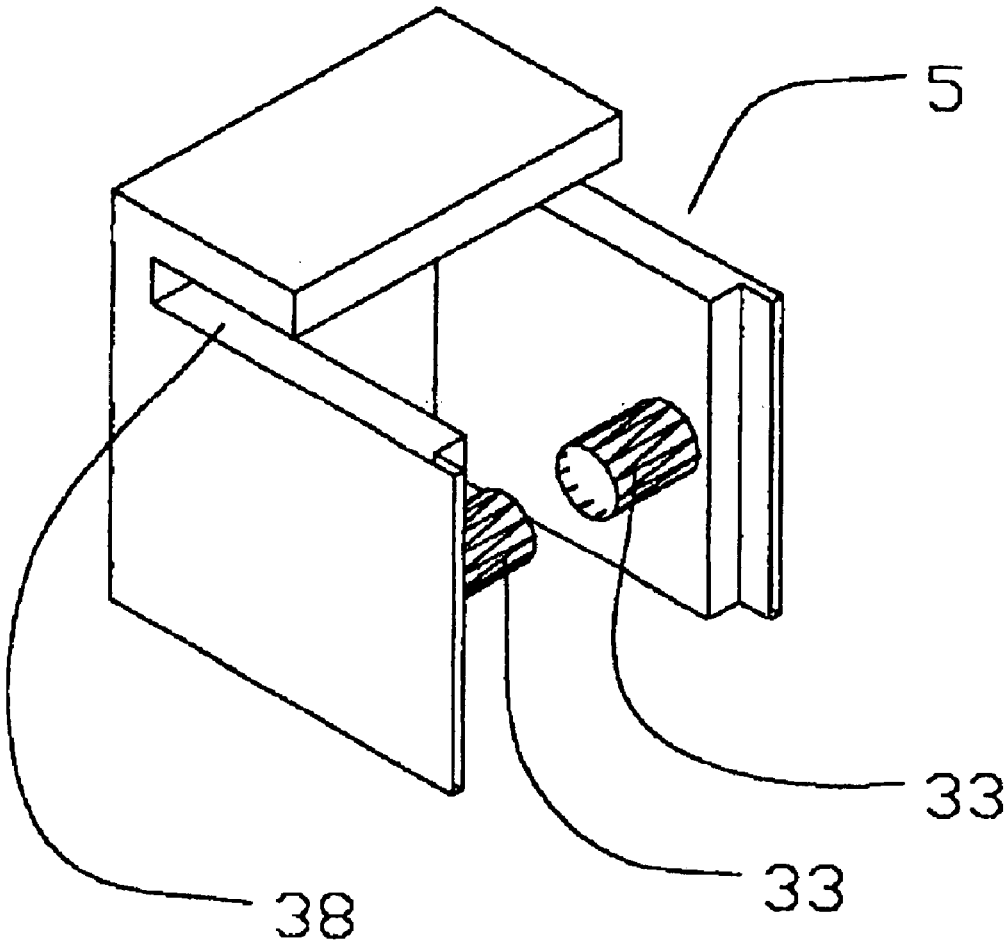
FIG. 6 is a perspective rendition of the end fastener.

FIG. 6 is a detail of the end fastener 5. The end fastener 5 has two pins 33 formed as part of, or attached to, and extending from the inside surfaces of end fastener 5 having a clearance between the free ends of pins 33 slightly larger than the small end width of the support member tapered slots 32 or the thickness of the support member between the end depth of the holes 31. The height of pins 33 are slightly less than the height of the support member slot 32 and hole 31 to allow the pins 33 to slide within the slot 32 and engage the hole 31. The pins are shown round but any suitable shape can be used. Spring-loaded pins can be used if material is inelastic. A pin can be construed to mean a dowel, rod, bar, dimple, nipple, or the like. Slot 38 of end fastener 5 is of size and shape to fit over joist flange 17. The bottom of slot 38 is on the same plane as the top of support member 4. The end fasteners 5 when pushed into place engaging a support member 4 and joist flange 17 will lock the support member 4 to the bottom of joist 2 as shown in FIG. 1. Many other means of fastening the end fastener 5 to the support member 4 can be contrived which may or may not require the use of tools. Such as, drilling holes in the end fastener sides and through the support member 4 ends then passing a bolt through and securing with a nut.

Figure 7:
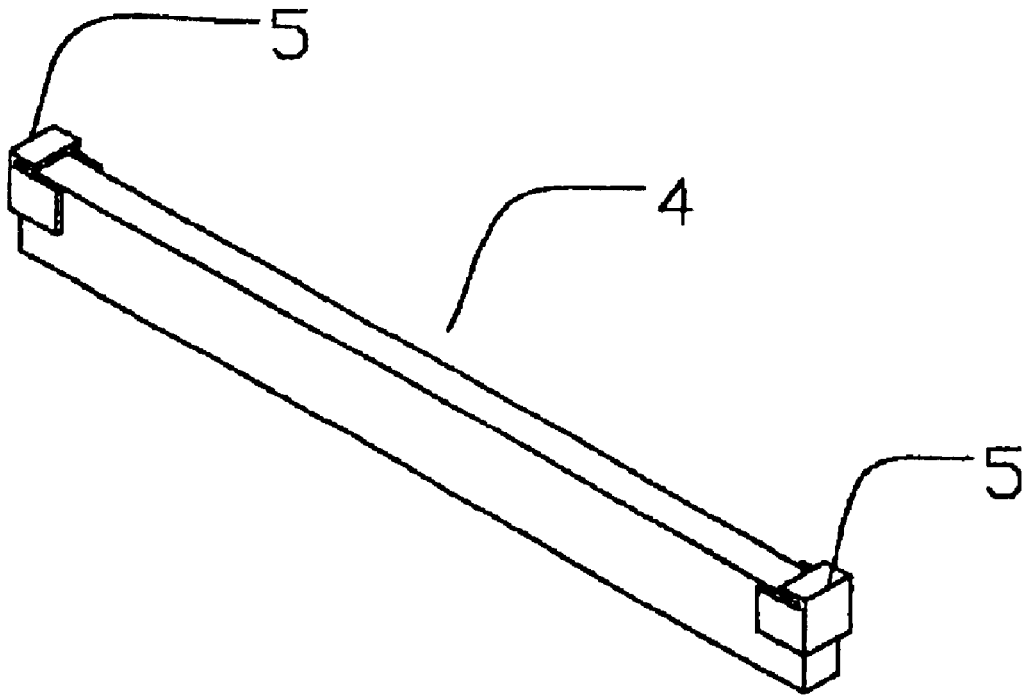
FIG. 7 is a perspective rendition of the support member and end fastener.

FIG. 7 shows the end fasteners 5 mounted on the support member 4.

Assembly and disassembly does not require any tools.

To assemble, set two runners 1 on a flat surface nearly parallel with inside surfaces facing each other. Insert a joist end 15 into an end slot 7 of one runner 1, next insert the opposite joist end 15 into the end slot 7 of the second runner 1. Similarly insert a second joist 2, if required, at the opposite end of the runners forming a rectangular shape. Continue inserting additional joists as needed until the required number of slots 7 are connected between the two runners 1.

After all the joists 2 are installed in runners 1, the retainer bar 3, with front surface 26 facing toward the inside of the pallet, is installed by inserting one tongue 19 into runner end 13 slot 8. With the one tongue 19 inserted in a runner slot 8, the retainer bar 3 is slightly bent until the retainer bar clears the runner end 14 allowing the free end tongue 19 to be inserted in the adjacent runner slot 8. As the tongue 19 enters runner slot 8 in runner end 14, apply pressure to retainer bar surface 26 (thereby causing depression of depressor 6) until surface 26 clears runner depressor 6. Runner depressor 6 moves back up to original position when retainer bar 3 is in place, thereby locking retainer bar 3 in place within runner 1. When retainer bar 3 is in the assembled position the retainer top surface 24 fits tightly against the bottom surface of joist bottom flange 17. Repeat the procedure to install the second retainer bar 3 on the opposite side of the pallet.

When the runners 1, required joists 2, and retainer bar 3 are in place the support member 4 with two end fasteners 5 can be installed. The support member 4 is set in place at approximately the center of the pallet, parallel to runners 1, and against joist bottom flange 17. The two end fasteners 5 are next installed one at each end of support member 4. As the end fastener 5 is pushed into place, the sides having the pins 23 attached bend outwardly, distorting until pins 33 reach hole 31 thereby sliding into hole 31. At the same time slot 38 of end fastener 5 slides over and encompasses flange 17. After repeating this procedure with the second end fastener 5 the support member 4 is locked in place with the two end joists 2 and the support member top surface 30 is flush with the bottom of joist flange 17. Repeat if additional support members are required. Support member 4 is used when additional support of joists 2 is needed. When assembled the bottom of the support member 4 is on a parallel plane with the bottom of runners 1 (all 3 sit flat and touch the floor).

Disassembly is accomplished in reverse order of assembly. Remove support member end fasteners 5 by slightly spreading the sides apart and sliding the end fasteners 5 off. Then remove the support member 4 (repeat for additional support members). Remove the retainer bar 3 by applying pressure to runner depressor 6 and to retainer bar back surface 27 by pushing through runner hole 9 causing the retainer bar 3 to bend releasing tongues 19. Repeat this procedure to remove the second retainer bar 3. The joists 2 can now be easily removed from the runners 1.

Assembling and disassembling would be easier with the pallet upside down with top of the pallet resting on a flat surface.

The phrase "formed as part of" as used herein applies to the use of a material where pieces can be manufactured as one piece. If the material used does not allow forming of parts then some attachment means can be substituted such as welding, screwing, bolting, clamping or the like.

While a preferred form of the invention has been shown in the drawings and described, since variations in the preferred form will be apparent to those skilled in the art, the invention should not be construed as limited to the specific form shown and described, but instead is as set forth in the following claims.

I claim:

1. A pallet comprising:

a first runner having an upper portion and a lower portion;

a second runner set apart and opposed from the first runner, said second runner having an upper portion and lower portion;

at least one joist having a first end, a second end, a top, and a bottom, said at least one joist first end attached to the first runner upper portion, and the at least one joist second end attached to the second runner upper portion;

a first retainer slidibly connected to the first runner lower portion and contacting the at least one joist first end bottom surface;

a second retainer slidibly connected to the second runner lower portion and contacting the at least one joist second end bottom surface;

whereby the first retainer and second retainer hold the at least one joist in vertical position, and the at least one joist top forming the pallet's flat surface.

2. A pallet as set forth in claim 1, wherein:

said first runner having an upper inside surface with at least one joist connecting keyway therein;

said second runner having an upper inside surface with at least one joist connecting keyway therein;

said at least one joist having a first end key, a second end key, a top flange continuous between keys of maximum length equal to the spacing between the first runner and second runner, and a bottom surface, said keys shaped to slidebly fit within the first runner and second runner joist connecting keyways, the at least one joist end keys to be slidebly engaged with the first runner and second runners joist connecting keyways, whereby the top flanges, first runner top surface, and second runner top surface form a continuous flat top pallet surface.

3. A pallet as set forth in claim 2, wherein:

said first runner having a first end lower surface with a retainer connecting slot therein, a second end having a lower surface with a retainer connecting slot therein, a bottom inside surface to allow nesting of said retainer into the first runner lower portion, said second end fastener connecting slots to be of the same form as the first end fastener slot and located directly opposite the first end fastener slot, a back surface having a hole therethrough centrally aligned in the lower portion;

said second runner having a first end lower surface with a retainer connecting slot therein, a second end having a lower surface with a retainer connecting slot therein, a bottom inside surface to allow nesting of said retainer into the second runner lower portion, said second end fastener connecting slot to be of the same form as the first end fastener slot and located directly opposite the first end fastener slot, a back surface having a hole therethrough centrally aligned in the lower portion;

said first retainer sufficiently flexible to allow slight bending, having a top surface, a first end tongue, and a second end tongue, the tongues shaped to slidebly fit within the first runner retainer connecting slots, the first retainer top surface contacting the at least one joist first end bottom surface thereby maintaining the at least one joist first end in vertical position within the at least one joist connecting keyway;

said second retainer sufficiently flexible to allow slight bending, having a top surface, a first end tongue, and a second end tongue, said tongues shaped to slidebly fit within the second runner retainer connecting slots, the second retainer top surface contacting the at least one joist second bottom surface thereby maintaining the at least one joist second end in vertical position within the at least one joist connecting keyway;

the first retainer being slightly bent lengthwise allows the first retainer end tongues to slide into the first runner retainer connecting slots, the first retainer elastically re-straightens thereby causing the first retainer to nest within the first runner lower portion;

the second retainer being slightly bent lenghtwise allows the second retainer end tongues to slide into the second runner retainer connecting slots, and the second retainer elastically re-straightens thereby causing the second retainer to nest within the second runner lower portion.

4. A pallet as set forth in claim 1, wherein:

said first runner having a first end, a lower surface with a retainer connecting slot therein, a second end having a lower surface with a retainer connecting slot therein, a bottom surface having depressing means to allow passage and nesting of said retainer into the first runner lower portion, said second end fastener connecting slot to be of the same form as the first end fastener slot and located directly opposite the first end fastener slot, a back surface having a hole therethrough aligned with and above the depressing means;

said second runner having a first end, a lower surface with a retainer connecting slot therein, a second end having a lower surface with a retainer connecting slot therein, a bottom surface having depressing means to allow passage and nesting of said retainer into the first runner lower portion, said second end fastener connecting slot to be of the same form as the first end fastener slot and located directly opposite the first end fastener slot, a back surface having a hole therethrough aligned with and above the depressing means;

said first retainer sufficiently flexible to allow slight bending, having a top surface, a first end tongue, and a second end tongue, said tongues shaped to slidebly fit within the first runner retainer connecting slots, the first retainer top surface contacting the at least one joist first end bottom surface thereby maintaining the at least one joist first end in vertical position within the first runner upper portion;

said second retainer sufficiently flexible to allow slight bending, having a top surface, a first end tongue, and a second end tongue, said tongues shaped to slidebly fit within the second runner retainer connecting slots, the second retainer top surface contacting the at least one joist second end bottom surface thereby maintaining the at least one joist second end in vertical position within the second runner upper portion;

said first retainer being slightly bent lengthwise allows the first retainer end tongues to slide into the first runner retainer connecting slots, the first retainer being pressed centrally re-straightens the first retainer, thereby causing the first retainer to pass over the first runner depressing means causing the first runner depressing means to retract, thereby the first retainer nests within the first runner lower portion, and locks into place when the first runner depressing means re-extends;

said second retainer being slightly bent lengthwise allows the second retainer end tongues to slide into the second runner retainer connecting slots, and the second retainer being pressed centrally re-straightens the second retainer, thereby causing the second retainer to pass over the second runner depressing means causing the second runner depressing means to retract, thereby the second retainer nests within the second runner lower portion and locks into place when the second runner depressing means re-extends.

5. A pallet as set forth in claim 4, wherein:

said first runner having an upper inside surface with at least one joist connecting keyway therein;

said second runner having an upper inside surface with at least one joist connecting keyway therein;

said at least one joist having a first end key, a second end key, a top flange continuous between keys of maximum length equal to the spacing between the first runner and second runner, and a bottom surface, said keys shaped to slidebly fit within the first runner and second runner joist connecting keyways, the at least one joist end keys to be slidebly engaged with the first runner and second runners joist connecting keyways, whereby the top flanges, first runner top surface, and second runner top surface form a continuous flat top pallet surface.

6. A pallet as set forth in claim 1, further comprising:

at least one support member attached to and contacting the at least one joist bottom;

thereby further strengthening and stiffening the assembled pallet.

7. A pallet as set forth in claim 6, wherein:

said at least one joist bottom is a flange;

said at least one support member having a top surface, a first end and a second end, spaced between said first runner and said second runner with support member top surface contacting the at least one joist bottom flange;

fastening means to attach the at least one support member first end to the at least one joist bottom flange of the at least one joist connected to said first runner first end and said second runner first end; fastening means to attach the at least one support member second end to said at least one joist bottom flange of the at least one joist connected to said first runner second end and said second runner second end.

8. A pallet as set forth in claim 7 wherein:

said at least one support member ends having horizontal recessed slots therein of given length from the free ends, and holes therein located at the given length from the free ends;

said fastening means having slots cut through to match the at least one joist bottom flange and pins sized to match the support member holes and slots;

whereby the fastening means is fixed to the at least one support member by sliding the attaching means pins within the at least one support member and horizontal slot thereby guiding the pins to engage the at least one support member holes and fixing the attaching means to the at least one support member ends, and simultaneously the fastening means slots slide over the at least one joist bottom flange causing the at least one support member to be in contact with the at least one joist bottom and attached to the at least one joist.

9. A pallet as set forth in claim 8, wherein said fastening means comprises:

a frame of resilient material having a back surface, a first side, and a second side, the first and second side inside surfaces each having a pin attached extending inward with ends spaced apart a distance matching said at least one support member thickness between said at least one support member holes, the first and second sides having flange slots therethrough extending from the front towards the back of a shape to fit over said joist bottom flange and spaced above the pins.

10. A method of assembling a pallet which comprises:

placing a first runner;

placing a second runner parallel and opposed to the first runner;

slidebly connect at least one joist to first runner and to second runner;

installing a first retainer bar into the first runner by bending the first retainer, slidebly connecting the first retainer bar to the first runner, and pressing on the first retainer front causing the first retainer to depress the depressing means in the first runner bottom and thereby allowing the first retainer to pass over the depressing means nesting within the first runner, the depressing means thereby returning to the depressing means original position causing the first retainer to be locked into position within the first runner;

installing a second retainer bar into the second runner by bending the second retainer, slidebly connecting the second retainer bar to the second runner, and pressing on the second retainer front causing the second retainer to depress the depressing means in the second runner bottom and thereby allowing the second retainer to pass over the depressing means nesting within the second runner, the depressing means thereby returning to the depressing means original position causing the second retainer to be locked into position within the second runner.

11. A method of assembling a pallet as set forth in claim 10, further comprising:

placing at least one support member between said first runner and said second runner and below said at least one joist;

fastening each end of the support member to said at least one joist using fastening means.

12. A method of further disassembling a pallet further assembled as set forth in claim 11, comprising:

removing said fastening means from said at least one support member first end and joist bottom flange by spreading sides of said fastening means and pushing the fastening means away from the at least one support first end;

removing said fastening means from said at least one support member second end and joist bottom flange by spreading sides of said fastening means and pushing the fastening means away from the at least one support second end;

removing the at least one support member.

13. A method of disassembling a pallet assembled as set forth in claim 10, which comprises:

removing said first retaining bar from said first runner by pressing down on said depressing means in the first runner and pushing on back of the first retaining bar through hole provided in back of the first runner;

removing said second retaining bar from said second runner by pressing down on said depressing means in the second runner and pushing on back of the second retaining bar through hole provided in back of the second runner;

slidebly removing said at least one joist from said first runner and from said second runner;

removing said second runner;

removing said first runner.

14. A pallet as set forth in claim 1, wherein:

said first runner having a first end lower surface with a retainer connecting slot therein, a second end having a lower surface with a retainer connecting slot therein, a bottom inside surface to allow nesting of said retainer into the first runner lower portion, said second end fastener connecting slot to be of the same form as the first end fastener slot and located directly opposite the first end fastener slot, a back surface having a hole therethrough centrally aligned in the lower portion;

said second runner having a first end lower surface with a retainer connecting slot therein, a second end having a lower surface with a retainer connecting slot therein, a bottom inside surface to allow nesting of said retainer into the second runner lower portion, said second end fastener connecting slot to be of the same form as the first end fastener slot and located directly opposite the first end fastener slot, a back surface having a hole therethrough centrally aligned in the lower portion;

said first retainer sufficiently flexible to allow slight bending, having a top surface, a first end tongue, and a second end tongue, the tongues shaped to slidebly fit within the first runner retainer connecting slots, the first retainer top surface contacting the at least one joist first end bottom surface thereby maintaining the at least one joist first end in vertical position;

said second retainer sufficiently flexible to allow slight bending, having a top surface, a first end tongue, and a second end tongue, said tongues shaped to slidebly fit within the second runner retainer connecting slots, the second retainer top surface contacting the at least one joist second bottom surface thereby maintaining the at least one joist second end in vertical position;

the first retainer being slightly bent lengthwise allows the first retainer end tongues to slide into the first runner retainer connecting slots, the first retainer elastically re-straightens thereby causing the first retainer to nest within the first runner lower portion;

the second retainer being slightly bent lengthwise allows the second retainer end tongues to slide into the second runner retainer connecting slots, and the second retainer elastically re-straightens thereby causing the second retainer to nest within the second runner lower portion.

* * * * *